United States Patent [19]

Musall et al.

[11] 4,328,187

[45] May 4, 1982

[54] ELASTIC SUSPENSION FOR A MONOLITHIC CATALYZER BODY IN AN EXHAUST GAS CLEANING DEVICE

[75] Inventors: Reimar Musall, Burgdorf; Wilhelm Wolsing, Hanover, both of Fed. Rep. of Germany

[73] Assignee: Kali-Chemie AG, Hanover, Fed. Rep. of Germany

[21] Appl. No.: 376,338

[22] Filed: Jul. 5, 1973

[30] Foreign Application Priority Data

Jul. 10, 1972 [DE] Fed. Rep. of Germany ..... 2233886

[51] Int. Cl.[3] ..... F01N 3/15; B01J 8/02

[52] U.S. Cl. ..... 422/179; 422/180

[58] Field of Search ..... 23/288 F, 288 FC; 60/299, 300, 301; 181/56, 62; 55/DIG. 30; 422/179, 180

[56] References Cited

U.S. PATENT DOCUMENTS

| | | | |
|---|---|---|---|
| 3,227,242 | 1/1966 | Mattoon | 23/277 C |
| 3,248,188 | 4/1966 | Chute | 23/288 F UX |
| 3,441,381 | 4/1969 | Keith et al. | 23/277 C X |
| 3,692,497 | 9/1972 | Keith et al. | 23/288 F |
| 3,798,006 | 3/1974 | Balluff | 23/288 FC |

*Primary Examiner*—Barry Richman

*Attorney, Agent, or Firm*—Schwartz, Jeffery, Schwaab, Mack, Blumenthal & Koch

[57] ABSTRACT

An elastic holder for axial suspension of a monolithic catalyst body within a housing having a composite damping arrangement placed in the housing between the catalyst body and the housing walls and having a portion extending axially of the catalyst body for damping radial forces acting on the body, and end portions for damping axial forces acting on the catalyst body, and means cooperating with the damping means for elastically suspending the catalyzer body in the housing.

11 Claims, 6 Drawing Figures

ELASTIC SUSPENSION FOR A MONOLITHIC CATALYZER BODY IN AN EXHAUST GAS CLEANING DEVICE

FIELD OF THE INVENTION

The present invention relates to an elastic suspension for ceramic monolithic bodies, and more particularly it relates to the suspension of such monolithic bodies which are used as catalyzer carriers preferably in devices for the decontamination of exhaust gases of automobiles.

BACKGROUND OF THE INVENTION

The use of ceramic catalyzer carriers having a honeycomb structure for the cleaning of exhaust gases, especially for the cleaning of the exhaust gases of automobiles, has been already known. Such honeycomb structures combine two advantages. On one hand they possess a large surface with respect to a unit volume, on the other the flow resistance through them is very small. The difficulty of their use in devices for the decontamination of exhaust gases of automobiles resides in their required elastic suspension. The pushing forces and vibrations which occur during the travelling of the car, place a heavy mechanical requirement on the honeycomb structure so that finally this will lead to a destruction of the catalyzer carrier.

Elastic suspension for such honeycomb structures have been already proposed, such as by U.S. Pat. No. 3,441,382, which describes a catalyzer patron which exists from a ceramic monolithic catalyzer element placed in a metallic housing and in which, between the catalyzer and the housing wall, a heat insulating mass, such as fire resistant brick, or molten aluminum oxide, etc., is placed. By means of a metallic spring, which can be adjusted, a pressure is applied to the insulating mass so that the catalyzer body is retained fixedly in its position. Such suspension turned out to be, however, not sufficiently elastic. The pressure applied to the body of the catalyzer is too large and is not uniformly distributed in order to be able to prevent an gradual mechanical destruction of the honeycomb structure.

Another device for the catalytic decontamination of the exhaust gases of automobiles has been described in German DAS No. 1,476,507. In such a device the monolithic catalyzer is placed in a cylindrical housing between a pair of annular flanges which are in gas-tight connection with the housing. Into the annular gap between the housing and the catalyzer a resilient wavy member is placed which can be in form of a corrugated or wavy wire mesh which surrounds the catalyzer body very tightly.

The experience of the automobile industry, especially in the case of high revolution four-cycle engines, proves that the wavy-shaped wire mesh inserts cannot withstand the high thermal and mechanical loading even when the wire mesh is made from a high heat-resistant steel. The ceramic body which is embedded in the wire mesh begins to wander around within it when the spanning effect of the wire mesh has lost its original tight application. Then due to the subsequent large shaking and oscillating forces the ceramic body will become quickly destroyed.

SUMMARY OF THE INVENTION

It is therefore an object of the present invention to provide an improved elastic suspension for a ceramic body of the monolithic type preferably used as a catalyzer carrier in an exhaust gas cleaning arrangement for automobiles which is capable to withstand the severe shocks and oscillating forces arising during the travelling of the vehicle.

The present invention provides preferably for motor vehicles an apparatus for cleaning exhaust gases comprising a rigid housing forming an outer wall of the exhaust gas conduit, a shock sensitive catalyzer body of the monolithic type being placed for suspension axially within the housing, a composite damping element placed in the housing between the catalyzer body and the housing and having a portion extending axially of the catalyzer body for damping radial forces acting on the body, and end portions for damping axial forces acting on the catalyzer body, and means cooperating with the damping means for suspending the catalyzer body in said housing.

BRIEF DESCRIPTION OF THE DRAWINGS

The invention will become more readily apparent from the following description of preferred embodiments thereof shown in the accompanying drawings, in which.

DESCRIPTION OF THE PREFERRED EMBODIMENTS

Figure 2:
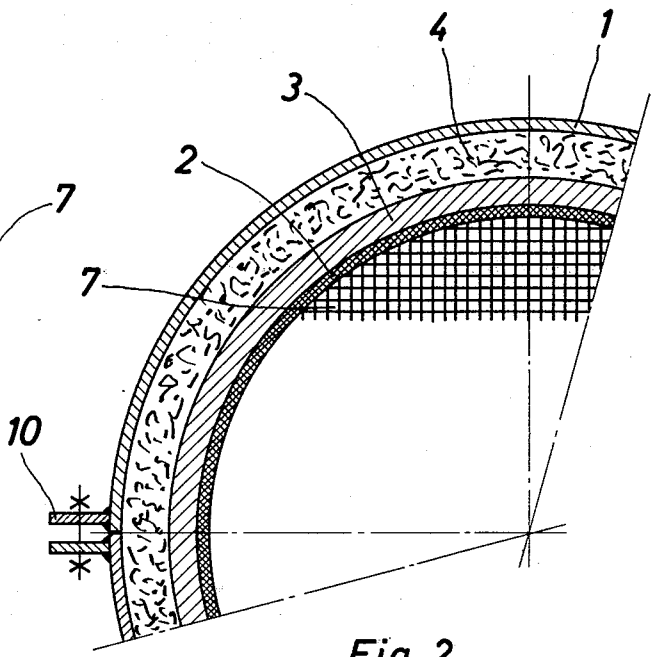
FIG. 2 is a cross-section through the structure of FIG. 1 in a transverse plane illustrating the elastic suspension.
Figure 1:
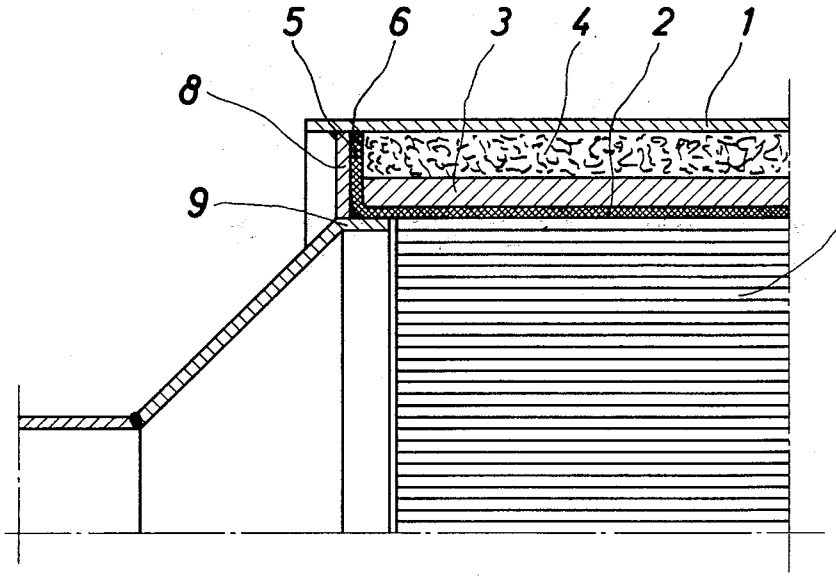
FIG. 1 is a partial longitudinal section of one quarter of the symmetrical housing containing the catalyzer body and its elastic suspension according to the present invention.

The apparatus including the inventive suspension for the preferably honeycomb structured shock sensitive catalyst body 7 within an exhaust gas cleaning arrangement as it can be seen in FIG. 1 includes a metallic housing 1 which is rigid and is closed at other portions than at the two ends thereof for the entry and exit of the exhaust gases thereto. As can also be seen in FIG. 1 the catalyzer body 7 is surrounded axially with the compensating layer 2 which is made from a heat resistant mineral fiber material and which at its end portions 6 is formed into an annular flange and serves as the axial damping element while the axially extending portions of material 2 serve as element for compensating geometric deviations and to prevent any by-pass of exhaust gas. Outside of the compensating layer a rigid sleeve 3 may be provided which consists of good heat insulating mineral material and which extends over the entire length of the catalyzer body 7 within the housing 1. The jacket or sleeve 3 can be made as a tube having an integral construction or from two pipe halves or from several sections. Around the sleeve 3 there is a layer 4 provided made from a highly elastic material, such as foamed asbestos, or a glass fiber fleece or from a metallic wire mesh cushion and serves as a damping element and extends within the housing 1 over the entire length of the catalyst body and elastically suspends the catalyst body together with the material 2 and sleeve 3 against the rigid walls of the housing 1. An end wall 8 and a collar 9 form a chamber for the elastic suspension elements of the catalyst body which chamber is not flown through by the exhaust gases and contains only the above described suspending elements. As can be seen in FIG. 1 the compensating layer 2 with its flange 6 abutts against end wall 8 while sleeve 3 wedges flange 6 against wall 8 and against collar 9, whereby the body 7 is elastically suspended axially and radially within the housing 1. Housing 1 may be an integral tube or once cut in axial direction for compensating possible radial tolerances as to be seen in FIG. 2. Device 10 are two axial flanges to bolt the housing and to provide the necessary pressure on the internal parts.

Figure 3:
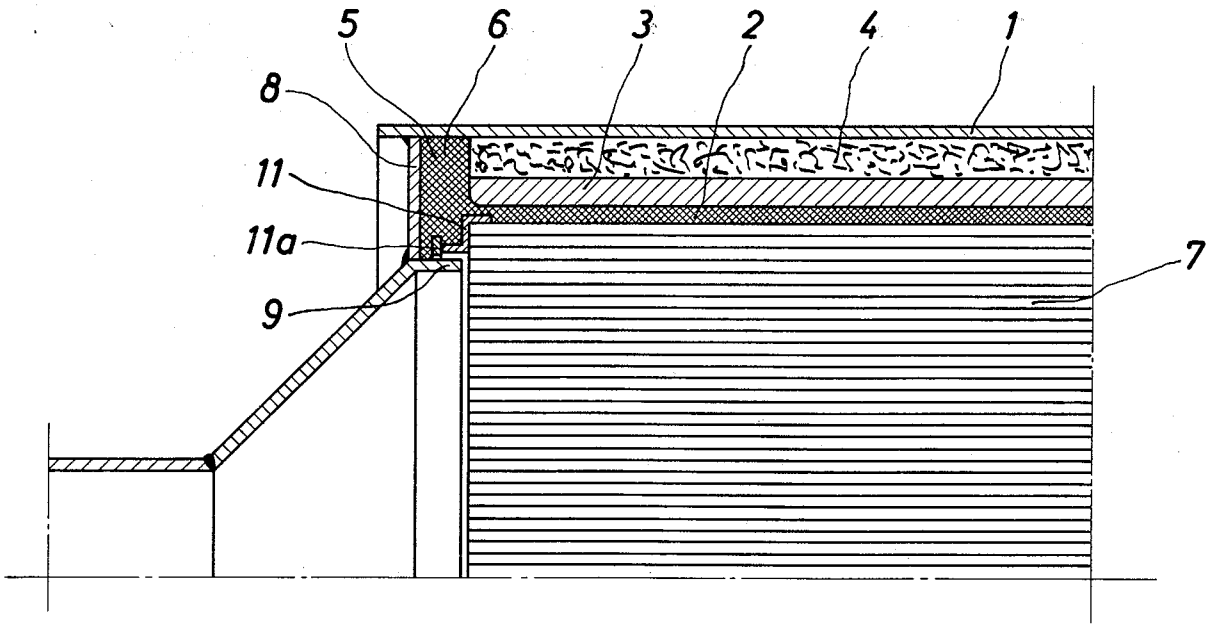
FIG. 3 is a longitudinal section partially through the apparatus according to the present invention having an alternative elastic suspension of the ceramic catalyzer body.

With reference to FIG. 3 which generally has a similar construction as the device of FIG. 1, it is seen that the compensating layer 2 of the mineral fiber at its end portions, this time is formed into a cushion 6 annularly running around the catalyst body 7 and such radial cushion 6 is placed on a ring 11 which annulary surrounds the catalyst body 7 and for improved cooperation of the cushion 6 with the catalyst body 7 and for improved compensation against the gas pulsation, the ring 11 can axially cooperate with an additional ring 11a lying against a forwardly protruding part of the ring 11.

Figure 4:
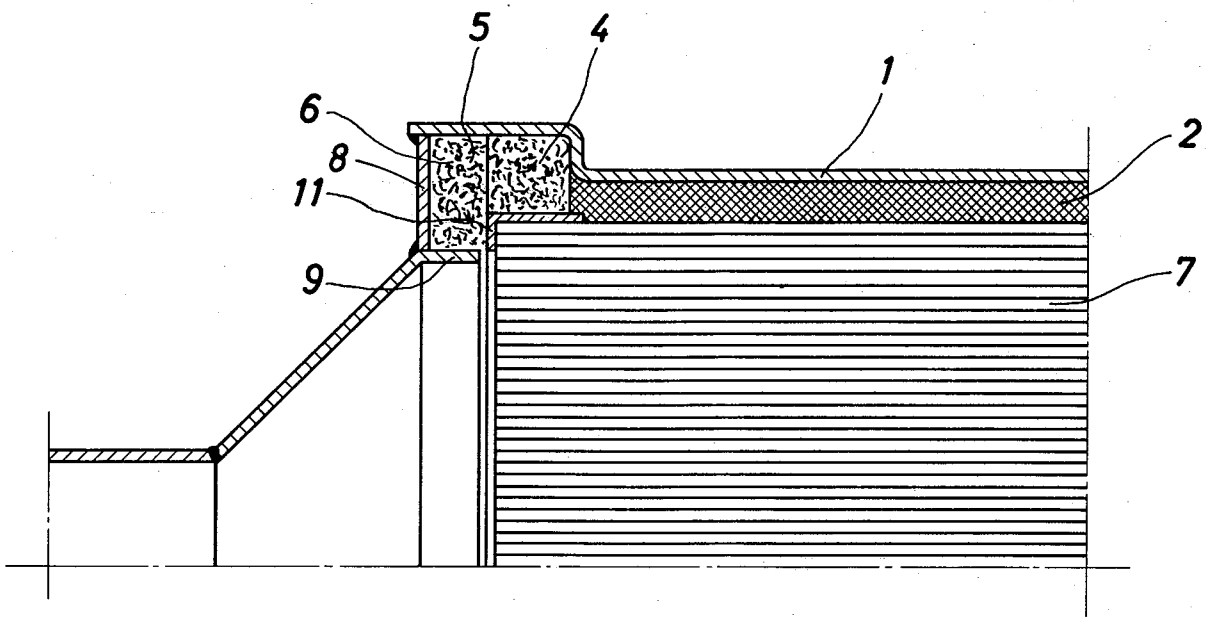
FIG. 4 is a longitudinal section through an alternative embodiment of the present invention.
Figure 6:
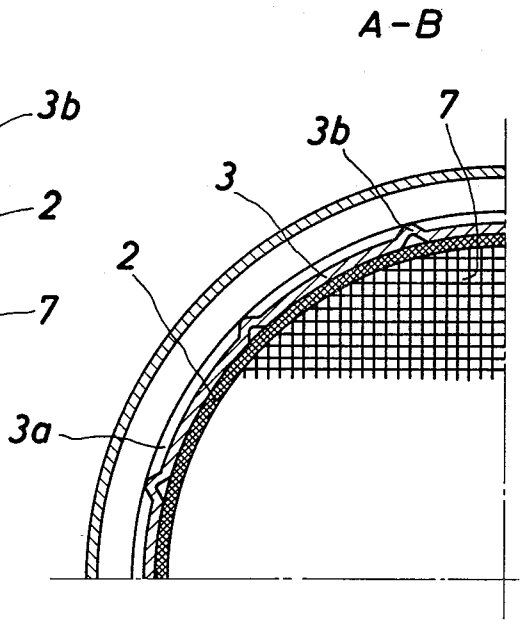
FIG. 6 is a cross section along line A–B in FIG. 5.

In the embodiment shown in FIG. 4 an angular collar 11 between catalyst body 7 and cushions 6 and 4 is provided for the protection of catalyst body 7 and the wire mesh.

Here means 2 of the heat resistant mineral fiber is placed in the middle part of the space between housing 1 and catalyst body 7; in this embodiment its main function is to prevent any by-pass of the exhaust gas. In this embodiment an end chamber 5 is formed between the housing wall 1 and collar 9, ring 11 and end wall 8, which contains the cushion 6 made of the metal wire and is shaped as an annular ring. Also the damping element 4 surrounding the catalyst body 7 in the embodiment of FIG. 3 here is squeezed in the form of an annular cushion 4 and placed adjacently to the cushion 6. The material of the cushions 4 and 6 is metal wire mesh. It is noted that in the embodiment according to FIG. 4 the cushions 6 and 4 can be made integrally in form of an L.

Figure 5:
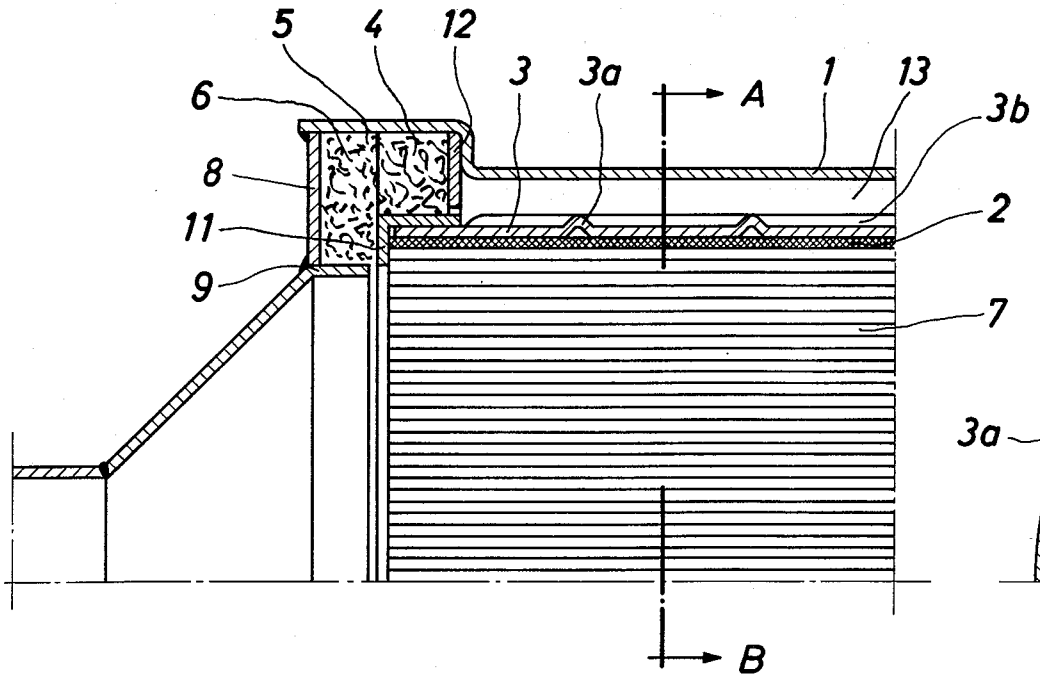
FIG. 5 is a partial longitudinal section through a catalyzer apparatus having an improved stiffening means.

With reference to FIG. 5 it is seen that instead of the smooth rigid sleeve of the previously described embodiment, here the sleeve 3 consists of heat resistant metal in the form of a closed cylinder which can have a longitudinal slot made therein or consisting of a pair of halves or several sections. The jacket or sleeve 3 can be made to have ribs 3*a* circumferentially or also longitudinally in order to provide for additional stiffening of the sleeve 3. At the end of the structure according to FIG. 5 an end chamber 5 is formed through the cooperation of the wall portions of the housing 1, wall portion 8 and collar 9 as well as an end ring 11 which is formed in the indicated angular fashion for axially restraining the end of the catalyst body 7 and sleeve 3. The end of the chamber 5 is sealed off by an annular disc 12. The chamber 5 contains the damping cushions 4 and 6 as in the embodiment according to FIG. 4. It is seen that between sleeve 3 and the outer wall 1 of the housing a chamber 13 is formed which can be void or can be filled with a ceramic fiber in order to provide for a better sealing off of the catalyzer apparatus. It is noted that the disc 12 is not fixedly secured with wall 1, therefore, the elastic effect of cushions 4 and 6 can be transmitted to disc 12.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. In a catalyzer for detoxifying exhaust gases from internal combustion engines, wherein a monolithic catalyst body having an outer surface and facing ends is supported in a housing having an inner surface, by support means arranged between said inner surface of said housing and said outer surface of said monolithic catalyst body, the improvement wherein said support means comprise elastically yielding means, and holding means for locating said elastically yielding means at least partially between each facing end of said monolithic catalyst body and the inner surface of said housing, whereby the monolithic catalyst body is elastically restrained in said housing against movement in all three dimensions of space, wherein said elastically yielding means are elastically deformable damping rings having an inner diameter, said holding means comprising inner supporting means located in said housing for holding said rings at the respective inner diameter thereof whereby the damping rings are securely seated on the respective inner supporting means and thus between the inner housing surface and the respective facing end of the monolithic catalyst body.

2. A catalyzer as claimed in claim 1, wherein said inner supporting means comprises a collar member extending axially into said housing from each inner end surface of said housing.

3. A catalyzer as claimed in claim 1, wherein said elastically yielding means are comprised of foamed asbestos, glass fiber fleece or metallic wire mesh.

4. A catalyzer as claimed in claim 1, wherein said support means includes a first elastically deformable damping ring circumferentially surrounding the outer surface of said catalyst body and two second elastically deformable damping rings seated on said inner supporting means between the inner housing surface and the respective facing ends of said catalyst body.

5. A catalyzer as claimed in claim 4, wherein said first and second elastically deformable damping rings are integrally formed with one another.

6. A catalyzer as claimed in claim 1, further comprising a compensating and heat sealing layer comprising a heat resistant mineral fiber material surrounding the outer surface of said monolithic catalyst body.

7. A catalyzer as claimed in claim 6, further comprising a rigid sleeve surrounding said compensating and heat sealing layer over at least a portion of its length.

8. A catalyzer as claimed in claim 7, wherein said rigid sleeve is comprised as a plurality of sections.

9. A catalyzer as claimed in claim 7, wherein said rigid sleeve comprises a heat insulating mineral material.

10. A catalyzer as claimed in claim 7, wherein said rigid sleeve comprises a metal.

11. A catalyzer as claimed in claim 10, wherein said rigid sleeve includes a plurality of ribs extending in at least one of the axial or circumferential directions.

* * * * *